United States Patent [19]

Robarge et al.

[11] Patent Number: 4,959,514

[45] Date of Patent: Sep. 25, 1990

[54] FUSIBLE ELECTRIC SWITCH

[75] Inventors: Dean A. Robarge, New Britain; John A. Morby, Farmington; Andre J. M'Sadoques, Southington; Robert G. Markowski, Wallingford, all of Conn.

[73] Assignee: General Electric Company, New York, N.Y.

[21] Appl. No.: 405,172

[22] Filed: Sep. 11, 1989

[51] Int. Cl.[5] ..... H01H 33/08
[52] U.S. Cl. ..... 200/144 R
[58] Field of Search ..... 200/144 R

[56] References Cited

U.S. PATENT DOCUMENTS

| | | | |
|---|---|---|---|
| 3,958,095 | 5/1976 | Zaffrann et al. | 200/144 R |
| 4,286,130 | 8/1981 | Troebel | 200/144 R |
| 4,778,959 | 10/1988 | Sabatella et al. | 200/144 R |

*Primary Examiner*—Robert S. Macon
*Attorney, Agent, or Firm*—Richard A. Menelly; Walter C. Bernkopf; Fred Jacob

[57] ABSTRACT

A Fusible electric switch is herein described for increased ratings within industrial electrical distribution circuits by the provision of an arc exhaust gas controller. The arc gas controller cools and deionizes the arc gases that are generated upon separation of the switch contacts and exhausts the gases in a predetermined direction outside the switch enclosure. Fuse pullers are arranged at one end of each of the switch fuses to facilitate both installation and removal of the fuses.

14 Claims, 5 Drawing Sheets

FUSIBLE ELECTRIC SWITCH

BACKGROUND OF THE INVENTION

U.S. Pat. No. 4,778,959 describes a fused disconnect switch of simplified construction that operates over a wide range of circuit ampere ratings. This patent is incorporated herein for reference purposes and should be reviewed for its teaching of the operating handle and the rotary blade operating assembly.

When the switch is employed within circuits in excess of its ampere rating, the intense electric arc that is generated upon separating the energized contacts, generates gaseous by-products in excess of the arc chute capacity. The large amount of exhaust gas generated at the higher ratings could seep into the switch compartment and contaminate the other switch operating components.

It would be beneficial to use the aforementioned switch design within higher ampere rated circuits without a substantial redesign in the size and arrangement of the switch components.

One purpose of the instant invention, accordingly, is to provide an arc exhaust gas controller for use with a standard fuse switch design to enable a single design to be used over a wider range of ampere ratings. A further purpose of the invention is to provide a simplified fuse puller to allow the switch fuses to be easily inserted and removed without requiring any auxiliary tools.

SUMMARY OF THE INVENTION

The ampere rating of a standardized fused switch design is increased by the provision of an arc exhaust gas controller that interacts between the switch isolation baffles and the switch rotor assembly to drive the exhaust gases out from the switch enclosure in a single predetermined direction. A simple fuse puller is arranged at one end of each of the fuses to allow the fuses to be installed and removed without requiring any auxiliary tool.

DESCRIPTION OF THE PREFERRED EMBODIMENT

Figure 1:
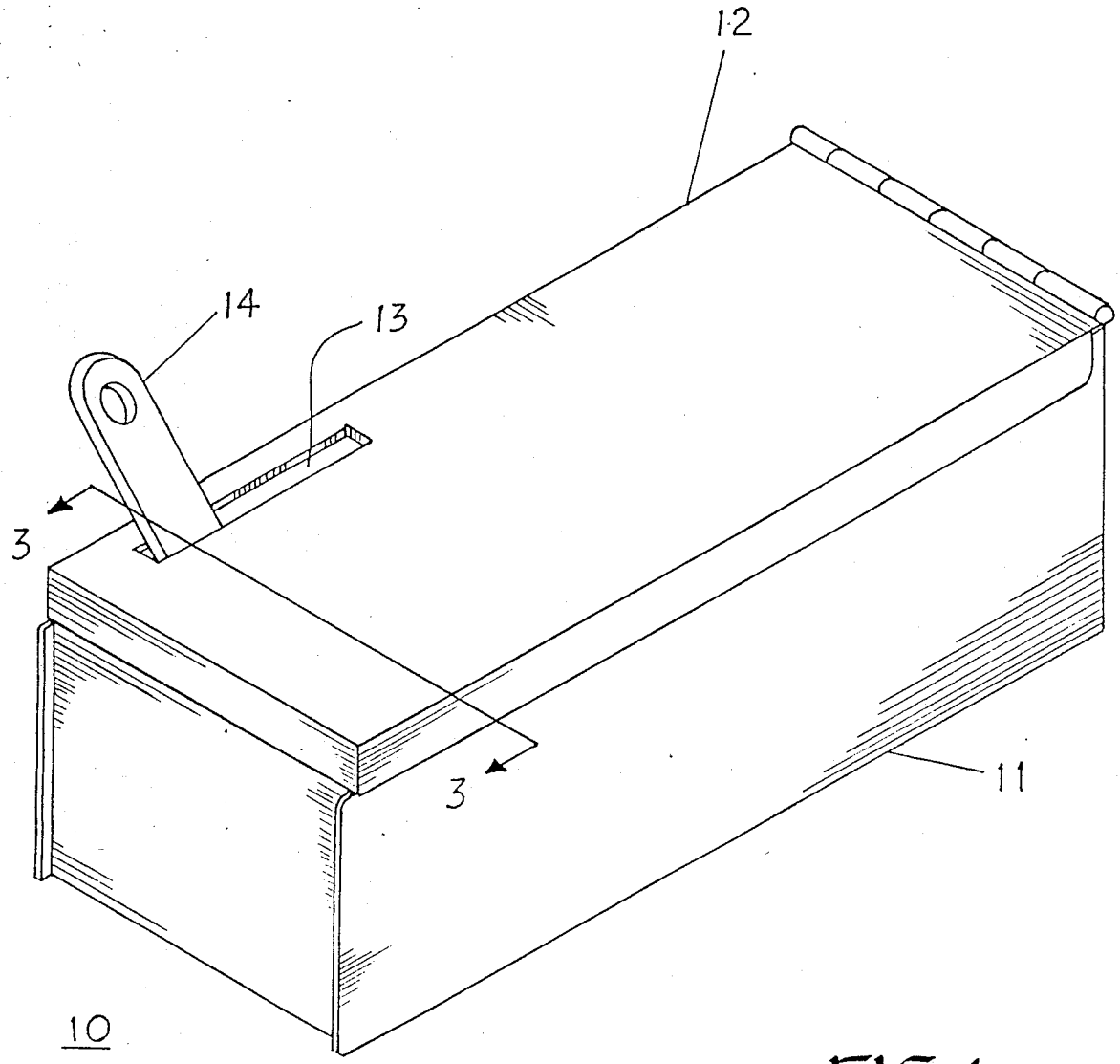
FIG. 1 is a top perspective view of a fused electric switch in accordance with the invention.

The fused electric switch 10 of FIG. 1 is similar to that described in the aforementioned U.S. Patent and consists of a metallic case 11 to which a metallic cover 12 is hingeably attached. ON-OFF operation of the switch is performed by means of the operating handle 14 that extends through the slot 13 formed in the metallic cover.

Figure 2:
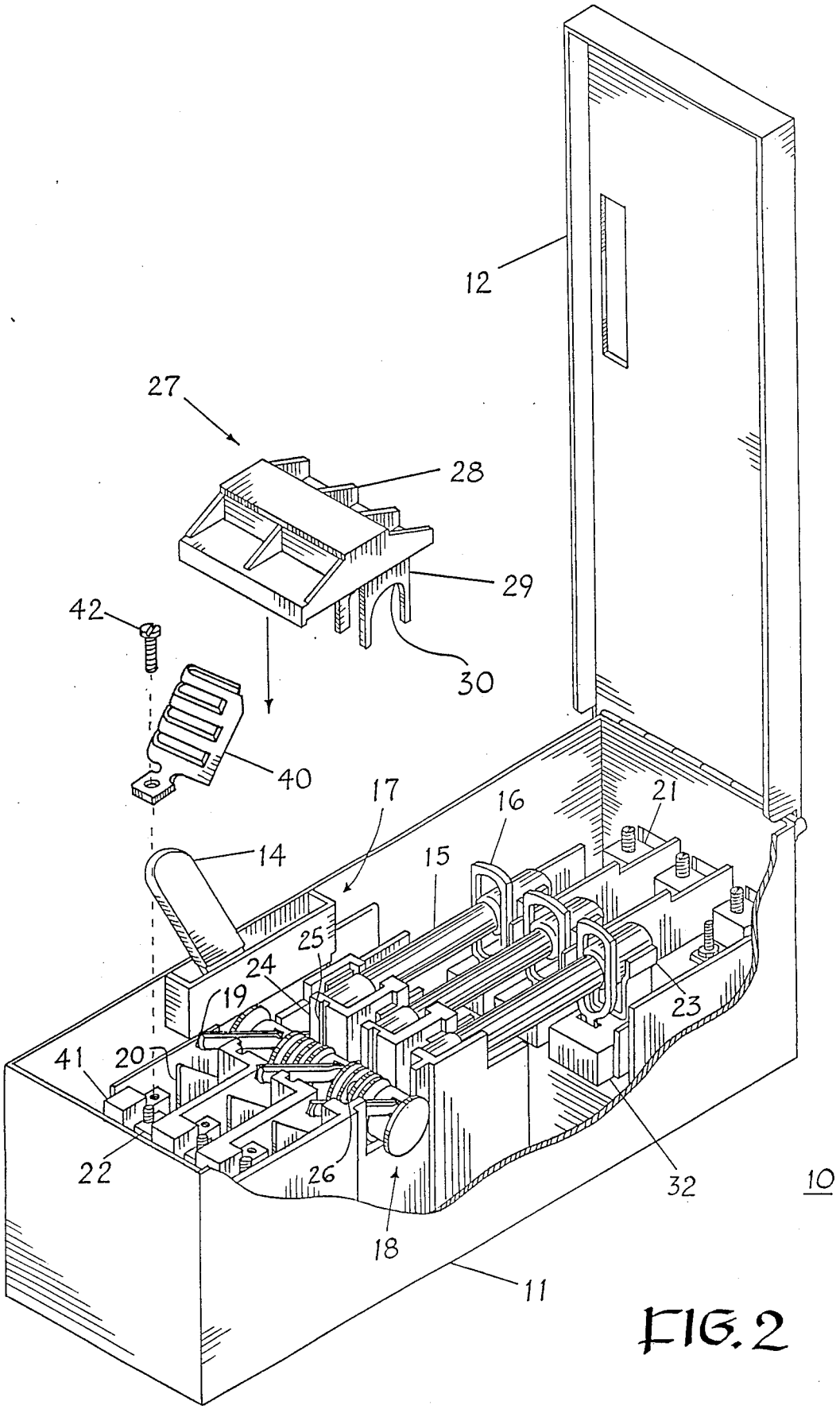
FIG. 2 top perspective view of the switch of FIG. 1 with the cover open and the arc controller removed.

The switch 10 is depicted in FIG. 2 with the cover 12 in its open position prior to the insertion of the arc exhaust gas controller 27. The arc gas controller 27 is fabricated from a single piece of thermoplastic resin and defines integrally-formed top baffles 28 and downwardly extending bottom baffles 29. The ends of the top baffles are received within corresponding slots 25 formed within the isolation barriers 24 within the case 11. The radial slots 30 formed in ends of the bottom baffles 29 are received within corresponding grooves 26 formed radially within the rotor assembly 18. The rotor assembly is driven by means of the operating handle 14 and operating mechanism 17, which are fastened to the interior surface of the case 11. As further described within the aforementioned U.S. Patent, three contact blades 19 are carried by the rotor assembly for becoming received within corresponding connector stabs 20 extending upward from the insulative support base 41. The individual arc chutes 40 are positioned over the connector stabs and are fastened to the support base by means of screws 42. The line lugs 22 connect with the connector stabs at one end of the case and are arranged for electrical connection within an industrial rated electric power distribution circuit. When the contact blades 19 are received within the connector stabs 20, the circuit current proceeds through the fuses 15 which are positioned on the fuse support insulative base 32. To facilitate both installation and removal of the fuses from fuse clips 23, a fuse puller 16 is positioned on the support base and will be described below in greater detail. Electrical connection is made with the associated industrial power loads by means of the load lugs 21 located at the opposite end of the case.

Figure 3:
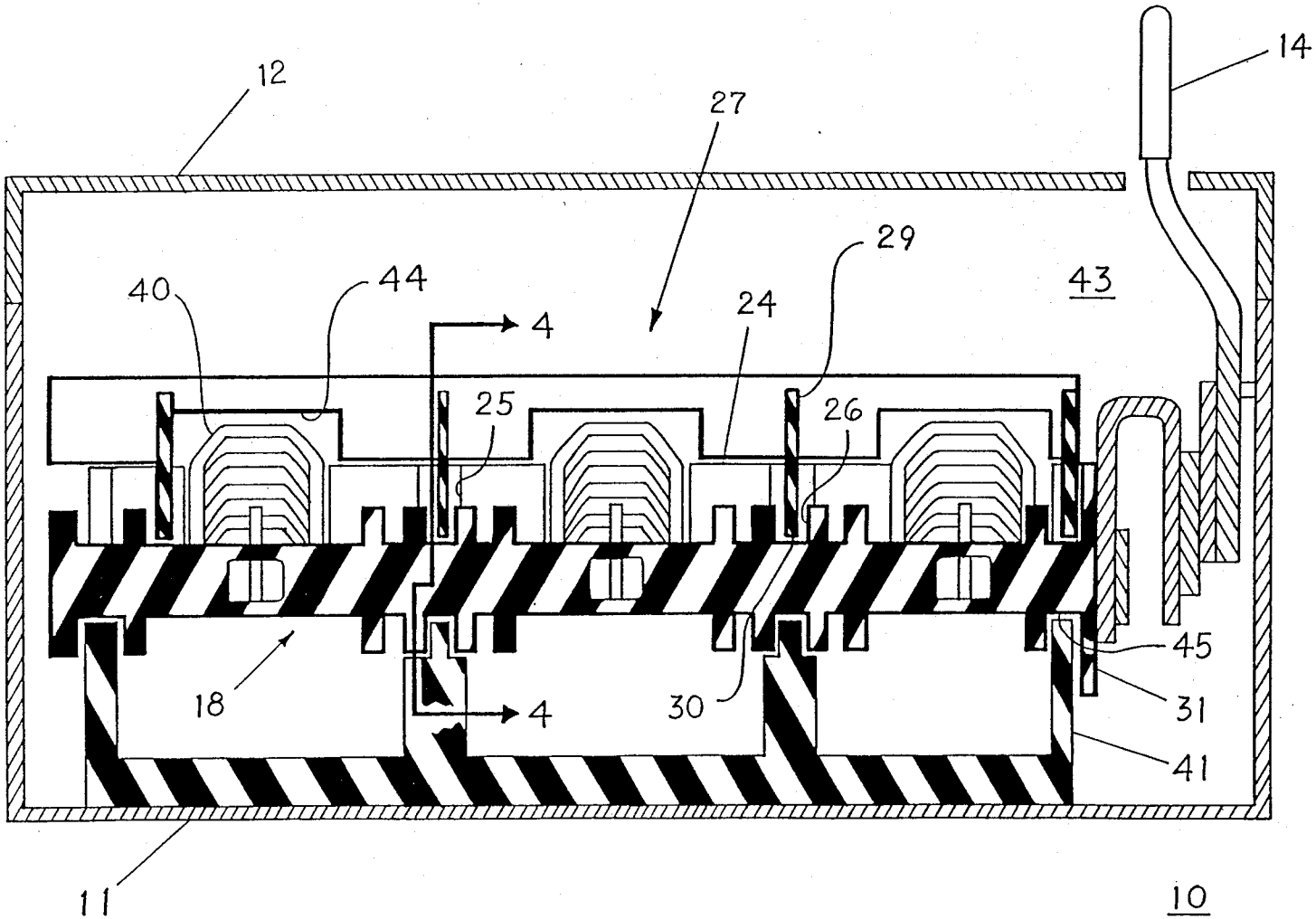
FIG. 3 is a sectional view of a part of the switch of FIG. 1 taken along the 3—3 plane.
Figure 4:
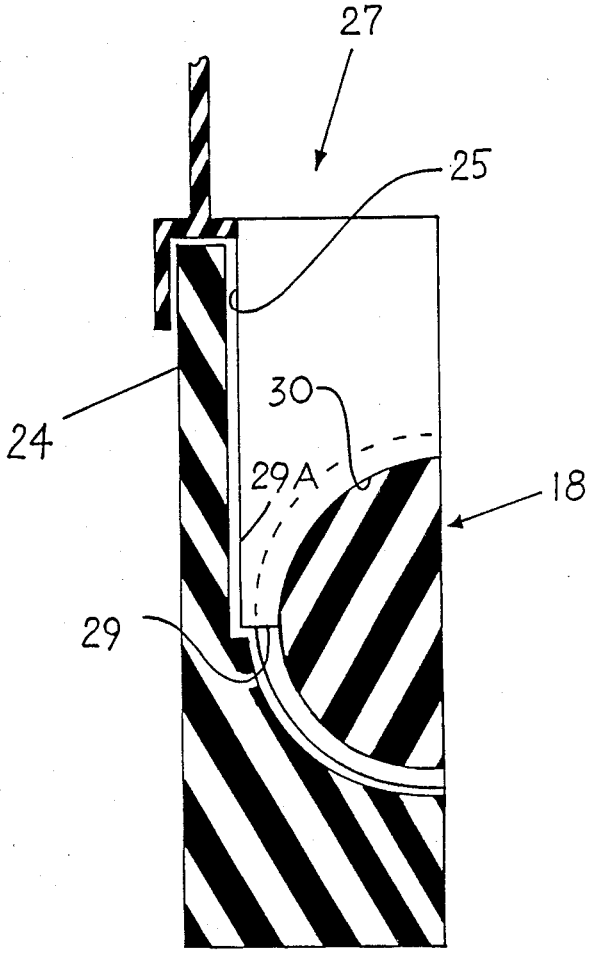
FIG. 4 is a sectional view of the switch of FIG. 3 taken along the 4—4 plane.

The tight gas seal arrangement between the arc gas controller 27 and the interior 43 of the switch 10 is best seen by referring now to FIG. 3 wherein the switch is depicted with the cover 12 tightly closed against the case 11. The rotor assembly 18 is assembled within the interior onto the base support 41 such that the outer rims 31 of the rotor assembly are rotatably received within the radial slots 45 formed on the top of the base support. The arrangement of the rotor assembly is better described within the aforementioned U.S. Patent which should be reviewed for its teachings of the entire rotor assembly-base support relationship. To provide hermetic sealing between the arc chutes 40 and the interior 43, the front parts of the bottom baffles 29 extend between the slots 25 in the barriers 24, as described earlier, while, at the same time, the radial slots 30 formed at the bottom ends of the bottom baffles are received within the radial grooves 26 formed within the rotor assembly. This allows the rotor assembly to move under the urgence of the operating handle 14 between its closed and open positions while preventing the arc gases generated within one arc chute from mixing with the exhaust arc gases generated within an adjoining arc chute. The openings 44 formed within the arc gas controller 27 allow for the controlled egress of the exhaust arc gases in a predetermined direction. The tight sealing arrangement between the arc gas controller 27 and the rotor assembly 18 is best seen now by referring to FIG. 4 wherein the radial slots 30 formed on the bottom of the bottom baffles 29 are supported upon the rotor assembly 18 and wherein the front parts 29A are shown arranged within the slots 25 in the barriers 24, as indicated.

Figure 5:
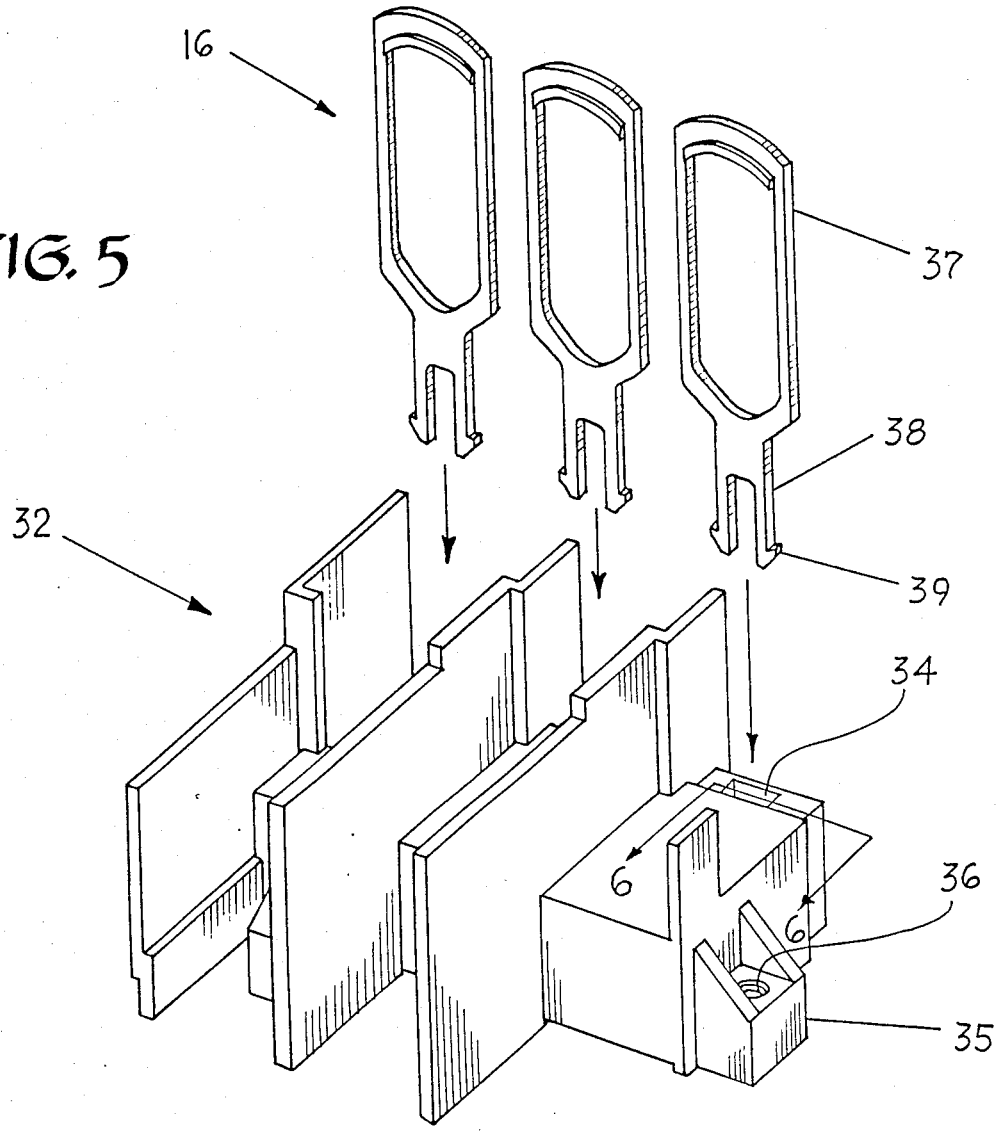
FIG. 5 a top view of the fuse base within the switch of FIG. 1 with the switch puller in isometric projection.

The arrangement of the fuse puller 16 on the fuse insulative support base 32 is best seen by referring now to FIG. 5 wherein the fuse puller is depicted as comprising a closed ring 37 of Lexan TM plastic, which is a GE trademark for polycarbonate resin having excellent tensile and thermal properties. The arc gas controller described earlier comprises Noryl TM plastic which is a GE trademark for a synthetic thermoplastic resin having excellent thermal and ablative properties for extinguishing and cooling the arc that occurs when the contact blades are rapidly separated from the connector stabs. The fuse pullers terminate with a pair of parallel legs 38, each of which has a hook 39 integrally-formed at one end thereof. The fuse puller is inserted within the support base 32 by passing the legs 38 within a corresponding slot 34 formed on top of the support base. The support base is fastened to the metallic case by means of the screw holes 36 integrally-formed within the pedestal 35 formed outboard the support base.

Figure 6:
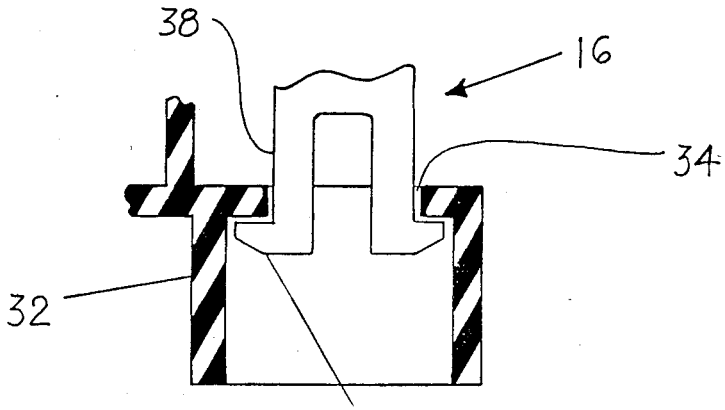
FIG. 6 is an enlarged side view of a part of the fuse base of FIG. 5 in partial section with the fuse puller connected.

The width of the slot 34 as shown in FIG. 6, is less than the total width of the legs including the spacing between the adjoining hooks 39 such that when the fuse puller 16 is thereby attached to the support base 32 it is unable to be removed without the use of a special tool to squeeze the legs 38 and reduce the total separation distance of the hooks 39 to less than the width of the slot 34. The fuse pullers can be repeatedly operated over long periods of time without becoming loose or removed due to the excellent wear resistant properties of the Lexan TM material and by the interlock arrangement between the hooks and the slot.

A fused electric switch having enhanced ampere ratings has herein been described which features the use of an arc gas controller for controlling the egress of the arc gases out from the switch enclosure. Also described is a fuse puller arranged at one end of each of the fuses within the switch for facilitating both the insertion and removal of the fuses.

Having thus described our invention, what we claim as new and desire to secure by Letters Patent is:

1. An electric fused disconnect switch comprising:

an enclosure including a metallic case and cover, said cover being hingeably connected to said as to define a switch interior;

a pair of line terminals at one end of said case for connection with an electric power distribution circuit and a pair of load terminals at an opposite end of said case for connection with an associated load;

an operating mechanism and a rotor within said case and arranged for moving a plurality of contact blades between closed and open positions within a corresponding plurality of contact stabs under the urgence of an operating handle;

a plurality of arc chutes arranged for cooling and extinguishing arcs that occur when said contact blades and stabs become connected ad disconnected while said line lugs are connected with said power distribution circuit;

an insulative arc gas controller arranged over said arc chutes, said arc gas controller having sealing means for sealing arc-generated gases from said interior and exhaust means for exhausting said gases in a predetermined direction outside said interior; and a first insulative base proximate said line terminals and arranged under said arc gas controller, said sealing means comprising first and second projections extending from said arc gas controller on opposite sides of said rotor and corresponding first and second barriers formed within said insulative base on siad opposite side, siad first and second projections being received within said first and second barriers.

2. The switch of claim 1 including a first fuse clip arranged on a top surface of said first insulative base.

3. The switch of claim 2 including a second insulative base proximate said load terminals, said second base supporting a second fuse clip.

4. The switch of claim 3 including a fuse extending between said first and second fuse clips.

5. The switch of claim 1 including a radial slot formed intermediate said first and second projections on said arc gas controller, said radial slot being received within a corresponding radial groove formed on said rotor.

6. The switch of claim 3 including a fuse puller encompassing a part of said fuse to allow said fuse to be inserted and removed without requiring an auxiliary tool.

7. The switch of claim 6 wherein said sécond base includes means for retaining said fuse puller.

8. The switch of claim 7 wherein said fuse puller comprises a unitary piece of plastic formed into a closed ring having a pair of legs extending from a bottom thereof.

9. The switch of claim 8 wherein each of said legs terminates in a hook.

10. The switch of claim 9 wherein said second base includes a pedestal having a slot of a predetermined width formed therein.

11. The switch of claim 10 wherein said legs define a predetermined width outboard said hooks, said width being less than said slot thickness whereby said hooks become trapped within said slot when said legs are inserted therein.

12. The switch of claim 1 wherein said arc gas controller includes a rectangular slot formed in a top part therein for providing said exhaust means to said arc gases in said predetermined direction.

13. The switch of claim 1 wherein said controller comprises a unitary piece of thermoplastic.

14. The switch of claim 8 wherein said plastic comprises thermoplastic.

* * * * *

UNITED STATES PATENT AND TRADEMARK OFFICE

CERTIFICATE OF CORRECTION

PATENT NO. : 4,959,514

DATED : 9/25/90

INVENTOR(S) : Robarge et al.

It is certified that error appears in the above-identified patent and that said Letters Patent is hereby corrected as shown below:

IN THE CLAIMS:

Claim 1, line 42, insert "case" after "said" and delete "as".

line 56, change "ad" to --and--.

Column 4, claim 1, line 14, change "siad" (two occurrences) to --said--.

Signed and Sealed this

Twenty-fourth Day of December, 1991

*Attest:*

HARRY F. MANBECK, JR.

*Attesting Officer*

*Commissioner of Patents and Trademarks*